US010062986B2

(12) United States Patent
Shibaya et al.

(10) Patent No.: US 10,062,986 B2
(45) Date of Patent: Aug. 28, 2018

(54) CONNECTOR AND CONNECTOR UNIT

(71) Applicant: J.S.T. Mfg. Co., Ltd., Osaka-shi (JP)

(72) Inventors: Takahiro Shibaya, Miyoshi (JP); Yasuo Kita, Miyoshi (JP); Yuichi Yoshiki, Miyoshi (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 0 days.

(21) Appl. No.: 15/475,984

(22) Filed: Mar. 31, 2017

(65) Prior Publication Data

US 2017/0302012 A1 Oct. 19, 2017

(30) Foreign Application Priority Data

Apr. 19, 2016 (JP) ..... 2016-083373

(51) Int. Cl.

| | |
|---|---|
| ***H01R 13/533*** | (2006.01) |
| ***H01R 33/975*** | (2006.01) |
| ***H01R 12/71*** | (2011.01) |
| ***H01R 13/512*** | (2006.01) |
| ***H01R 13/52*** | (2006.01) |

(52) U.S. Cl.
CPC ..... *H01R 12/71* (2013.01); *H01R 13/512* (2013.01); *H01R 13/5202* (2013.01)

(58) Field of Classification Search
CPC ..... H01R 13/6658; H01R 13/533; H01R 33/975; H01R 33/7664
USPC ..... 439/76.1, 382–385
See application file for complete search history.

(56) References Cited

U.S. PATENT DOCUMENTS 5,814,765 A * 9/1998 Bauer ..... H05K 5/0052 174/50.54
6,034,876 A * 3/2000 Ohno ..... H01R 9/18 361/736
7,104,810 B2 * 9/2006 Kawakita ..... H01R 13/6658 439/248
7,118,646 B2 * 10/2006 Hunkeler ..... B60R 16/0239 156/293
7,331,801 B1 * 2/2008 Eichorn ..... H01R 12/724 439/76.1
7,413,445 B2 * 8/2008 Inagaki ..... B60R 16/0239 439/76.1
7,419,385 B2 * 9/2008 Itou ..... H01R 12/724 439/76.1
8,942,001 B2 * 1/2015 Kawai ..... H05K 5/0052 174/50.5
8,979,554 B2 * 3/2015 Yudate ..... H01R 13/5202 439/271
2001/0039130 A1 * 11/2001 Nakamura ..... H01R 13/506 439/76.1

(Continued)

FOREIGN PATENT DOCUMENTS

JP 2015-22883 A1 2/2015

*Primary Examiner* — Gary Paumen
(74) *Attorney, Agent, or Firm* — Kratz, Quintos & Hanson, LLC

(57) ABSTRACT

A connector of the present invention includes an inner housing and an outer housing. The inner housing has a contact holding portion holding at least one contact, and is for attachment to a substrate. The outer housing is configured as a separate body from the inner housing, is provided between a case with the substrate attached thereto and the inner housing and is fixed to the case, and suppresses rattling of the inner housing relative to the case.

6 Claims, 12 Drawing Sheets

(56) References Cited

U.S. PATENT DOCUMENTS

2006/0046535 A1* 3/2006 Iida ..... H05K 5/062
439/76.1

* cited by examiner

CONNECTOR AND CONNECTOR UNIT

CROSS-REFERENCE TO RELATED APPLICATION

This application claims priority to Japanese Patent Application No. 2016-083373. The entire disclosure of Japanese Patent Application No. 2016-083373 is hereby incorporated herein by reference.

BACKGROUND OF THE INVENTION

1. Field of the Invention

The present invention relates to a connector and a connector unit that includes the connector.

2. Description of Related Art

A connector for connection to an electronic substrate accommodated in a case is disclosed in JP 2015-22883A for example. In this connector, a connector housing that accommodates connector pins therein is formed by an integrated part.

SUMMARY OF THE INVENTION

In the case of the connector disclosed in JP 2015-22883A, when the shape of the opening portion of the case that is the attachment target of the connector is changed according to a change in the design of the case or the like, the overall shape of the connector housing needs to be reexamined. There are cases where this therefore creates the need for connector performance to be evaluated and verified again.

The present invention was achieved in order to solve the aforementioned issue, and an object of the present invention is to provide a connector whose shape can be easily changed according to a change in the shape of the opening portion of the case to which the connector is to be attached.

(1) In order to solve the aforementioned issue, a connector according to one aspect of this invention includes: an inner housing that has a contact holding portion holding at least one contact, the inner housing being configured to be attached to a substrate; and an outer housing that is configured as a separate body from the inner housing, the outer housing being configured to be provided between a case with the substrate attached thereto and the inner housing and to be fixed to the case, and the outer housing suppressing rattling of the inner housing relative to the case.

According to this configuration, the inner housing holding the at least one contact is attached to the substrate, and then the substrate is placed in the case and fixed thereto. The outer housing is provided between the inner housing and the case in this state. Accordingly, the connector can be attached to the case and the substrate in a state where rattling of the inner housing relative to the case is suppressed.

Also, according to this configuration, even if the shape of the opening portion of the case that is the attachment target of the connector is changed according to a change in the design of the case for example, it is possible to change only the shape of the outer portion (outer housing) of the connector and use the connector body portion that has the at least one contact (contact and inner housing) as is. Accordingly, many individual parts used in the connector body portion can be used as is in other applications, and there is no need to again perform performance evaluation testing for such new connector body portions. Thereafter, according to this configuration, it is possible to reduce the cost of making alterations to the connector required by a design modification made to the case, and it is possible to reduce the number of man hours for additional performance evaluation testing that is to be performed.

Thereafter, according to this configuration, it is possible to provide a connector whose shape can be easily changed according to a change in the shape of the opening portion of the case to which the connector is to be attached.

(2) It is preferable that the inner housing has a fastening hole portion that is configured to be fastened to both the case and the substrate by a fastening member, a gap is formed between the inner housing and the case in a state where the substrate with the inner housing attached thereto is fastened to the case by the fastening member, and the outer housing is provided in the gap.

For example, conventionally known connectors have had problems such as the following when the substrate with such a connector mounted thereon is fixed to a case. Specifically, when the substrate with the connector mounted thereon is placed in and fixed to the case, the substrate and the connector are arranged at an appropriate position while pressing the seal ring or the like provided around the housing of the connector closely against the opening portion of the case, and then the substrate is fixed to the case by screw fastening or the like. However, when the substrate is placed at the predetermined position in the case while pressing the connector against the opening portion of the case, there are cases where, depending on how the seal ring undergoes elastic deformation, the substrate is fixed to the case in an overall distorted state. This distortion occurs in the mounted parts on the substrate as well.

In regards to this, according to the above configuration, first the substrate with the inner housing attached thereto is placed in the case, and then the fastening hole portion can be fastened by a fastening member to both the case and the substrate. At this time, a gap is formed between the inner housing and the case, and therefore the substrate does not become distorted.

Thereafter, the outer housing is pressed and fitted into the gap, and fixed to the case. At this time, stress is concentrated in the regions of the substrate in the vicinity of the locations where the inner housing is fastened to both the substrate and the case (referred to hereinafter as fastening location vicinal regions), and therefore distortion occurs in these fastening location vicinal regions. However, these fastening location vicinal regions are relatively small regions, and therefore very few mounted parts are mounted in these fastening location vicinal regions, or no mounted parts are mounted in these fastening location vicinal regions. In other words, all or almost all of the mounted parts on the substrate are mounted in regions of the substrate where distortion does not occur (regions other than the fastening location vicinal regions). In other words, according to this configuration, when the substrate with the connector attached thereto is fixed to the case, it is possible to suppress distortion of the mounted parts on the substrate, thus making it possible to greatly reduce the risk of damage or the like to the mounted parts.

(3) It is further preferable that the connector further includes a ring-shaped inner seal ring that is provided between the inner housing and the outer housing.

According to this configuration, waterproof capability between the inner housing and the outer housing can be appropriately ensured by the inner seal ring.

(4) It is further preferable that the connector further includes a ring-shaped outer seal ring that is provided between the outer housing and the case.

According to this configuration, waterproof capability between the outer housing and the case can be appropriately ensured by the outer seal ring.

Furthermore, according to this configuration, it is possible to obtain a two-tier structure in the diameter direction with the two seal rings (specifically, the inner seal ring and the outer seal ring are arranged concentrically). Accordingly, the height of the lips of the seal rings can be set to approximately half the conventional lip height, for example. Accordingly, it is possible to suppress pinching of the seal rings during mating, which can occur due to the lip height (specifically, during product assembly, the lip portions become sandwiched between the housings or between the housing and the case, for example).

(5) It is preferable that the outer housing has an outer housing attachment portion that is configured to be attached to the case by a screw.

According to this configuration, the outer housing can be appropriately and firmly fixed to the case using a screw.

(6) In order to solve the aforementioned issue, a connector unit according to one aspect of this invention includes a case, a substrate configured to be attached to the case, and any one of the above-described connectors that is configured to be attached to the substrate.

According to this configuration, it is possible to provide a connector unit that includes a connector whose shape can be easily changed according to a change in the shape of the opening portion of the case to which the connector is to be attached.

(7) It is preferable that an inner housing of the connector has a fastening hole portion that is configured to be fastened to both the case and the substrate by a fastening member, a gap is formed between the inner housing and the case in a state where the substrate with the inner housing attached thereto is fastened to the case, and an outer housing of the connector is provided in the gap.

According to this configuration, it is possible to suppress distortion of mounted parts on the substrate when the substrate with the connector attached thereto is fixed to the case.

Note that the above and other objects, features, and advantages of the present invention will become apparent by reading the following description with the attached drawings.

DETAILED DESCRIPTION OF THE INVENTION

Hereinafter, modes for carrying out the present invention will be described with reference to the drawings. The present invention is broadly applicable to a connector and a connector unit that includes the connector.

Figure 1:
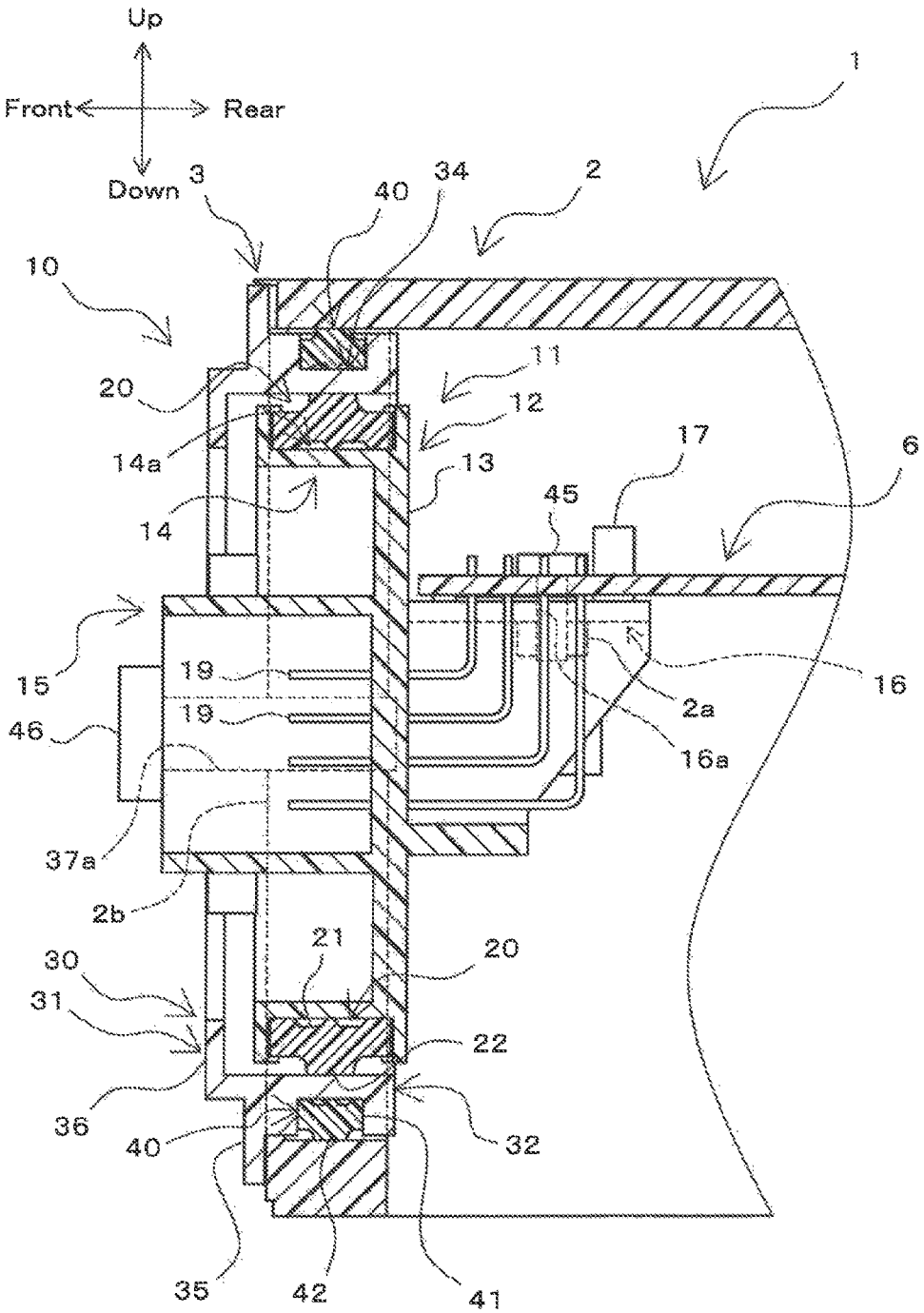
FIG. 1 is a cross-sectional view showing the vicinity of a male connector in an in-vehicle device according to an embodiment of the present invention.
Figure 2:
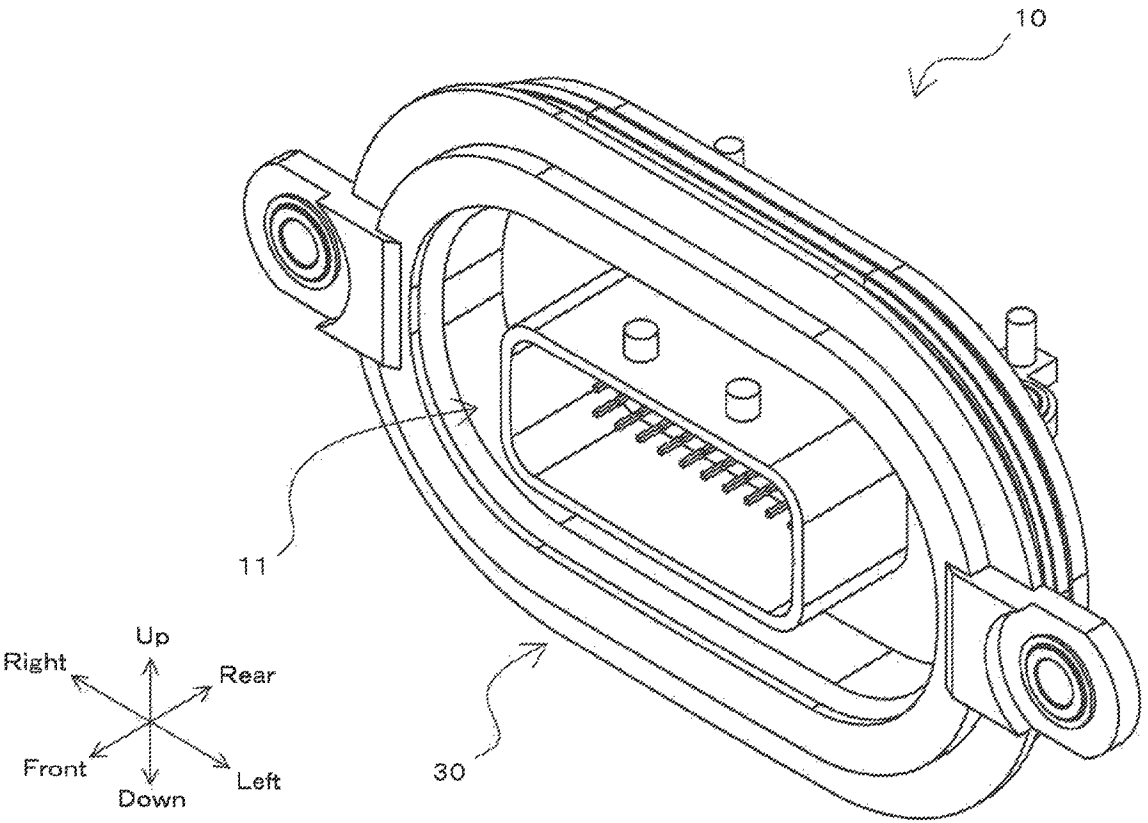
FIG. 2 is a perspective view of the male connector shown in FIG. 1, as viewed from the front side.
Figure 3:
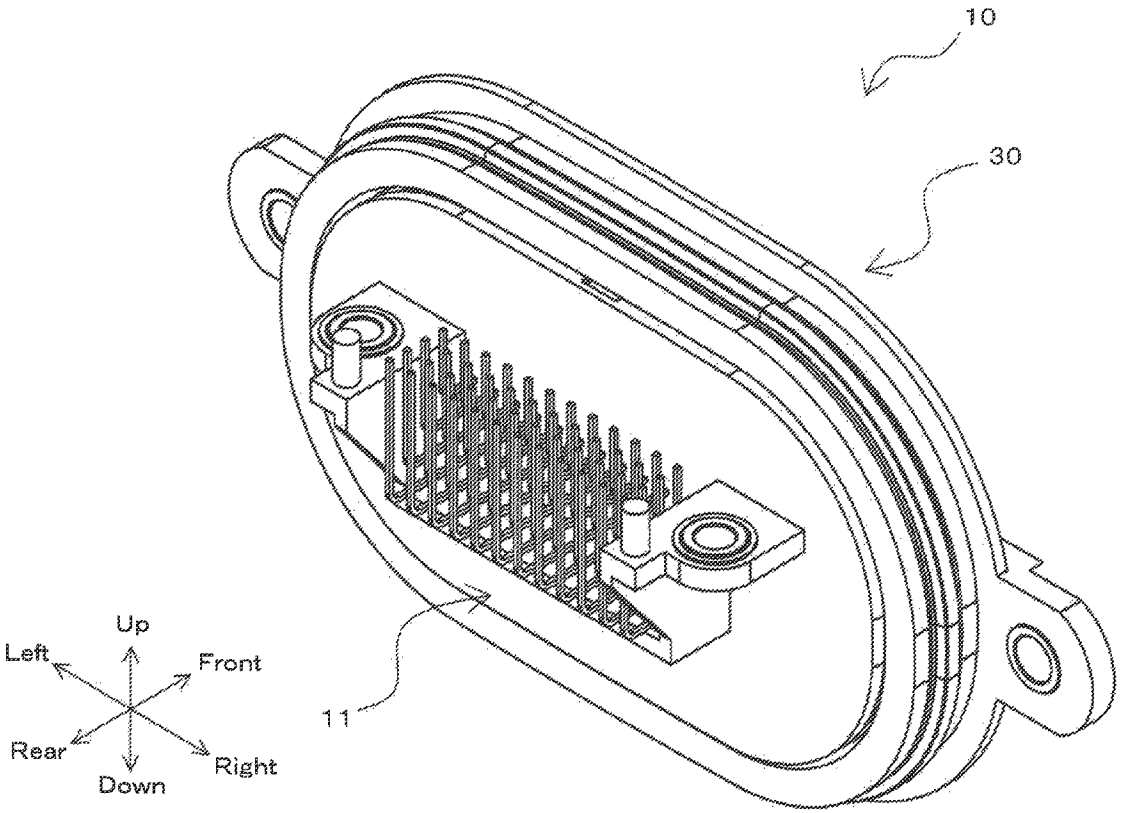
FIG. 3 is a perspective view of the male connector shown in FIG. 1, as viewed from the rear side.

FIG. 1 is a cross-sectional view showing a portion of an in-vehicle device 1 (connector unit) according to an embodiment of the present invention. Also, FIG. 2 is a perspective view of a male connector 10 shown in FIG. 1, as viewed from the front side. Moreover, FIG. 3 is a perspective view of the male connector 10 shown in FIG. 1, as viewed from the rear side.

Also, in the figures, for the sake of convenience in the description, the direction indicated by the arrow denoted by "right" will be referred to as rightward, the direction indicated by the arrow denoted by "left" will be referred to as leftward, the direction indicated by the arrow denoted by "up" will be referred to as upward, the direction indicated by the arrow denoted by "down" will be referred to as downward, the direction indicated by the arrow denoted by "front" will be referred to as frontward, and the direction indicated by the arrow denoted by "rear" will be referred to as rearward. The direction from front to rear is the direction in which a female connector (not shown) serving as a partner connector is mated with the male connector 10 (mating direction), and the direction from rear to front is the direction in which the female connector is withdrawn from the male connector 10 (withdrawal direction).

Overall Configuration of In-Vehicle Device

The in-vehicle device 1 includes a case 2, a substrate 6 on which mounted parts (not shown) are mounted, and the male connector 10 that is fixed to the case 2 in the state of being connected to the substrate 6. The in-vehicle device 1 is a device for installation in a vehicle such as an automobile. In the in-vehicle device 1, the substrate 6 with the male connector 10 mounted thereto is placed in and fixed to the box-shaped case 2. A portion of the male connector 10 on the leading end side (front side) is exposed to the outside through an opening portion 3 formed in the case 2. Also, in the in-vehicle device 1, a female connector is mated to the leading end side of the male connector 10 of the in-vehicle device 1, thus electrically connecting the two.

Overall Configuration of Male Connector

The male connector 10 has a male connector body portion 11 and a seal cover assembly 30. Although described in detail later, in the male connector 10, the seal cover assembly 30 seals a gap G (see FIG. 9) that exists between the male connector body portion 11 and the case 2 when the male connector 10 is fixed to the substrate 6. Accordingly, rattling of the male connector 10 relative to the case 2 can be suppressed, and waterproof capability can be ensured for the male connector 10.

Configuration of Male Connector Body Portion

Figure 4:
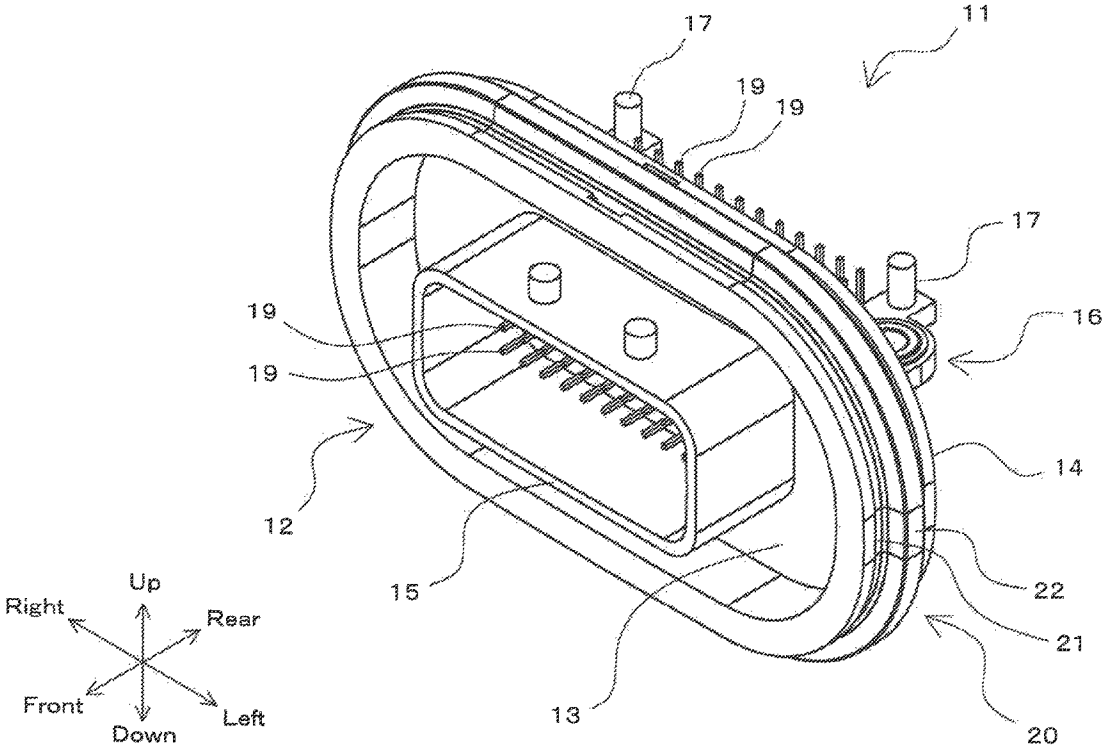
FIG. 4 is a perspective view of a male connector body portion shown in FIGS. 2 and 3, as viewed from the front side.
Figure 5:
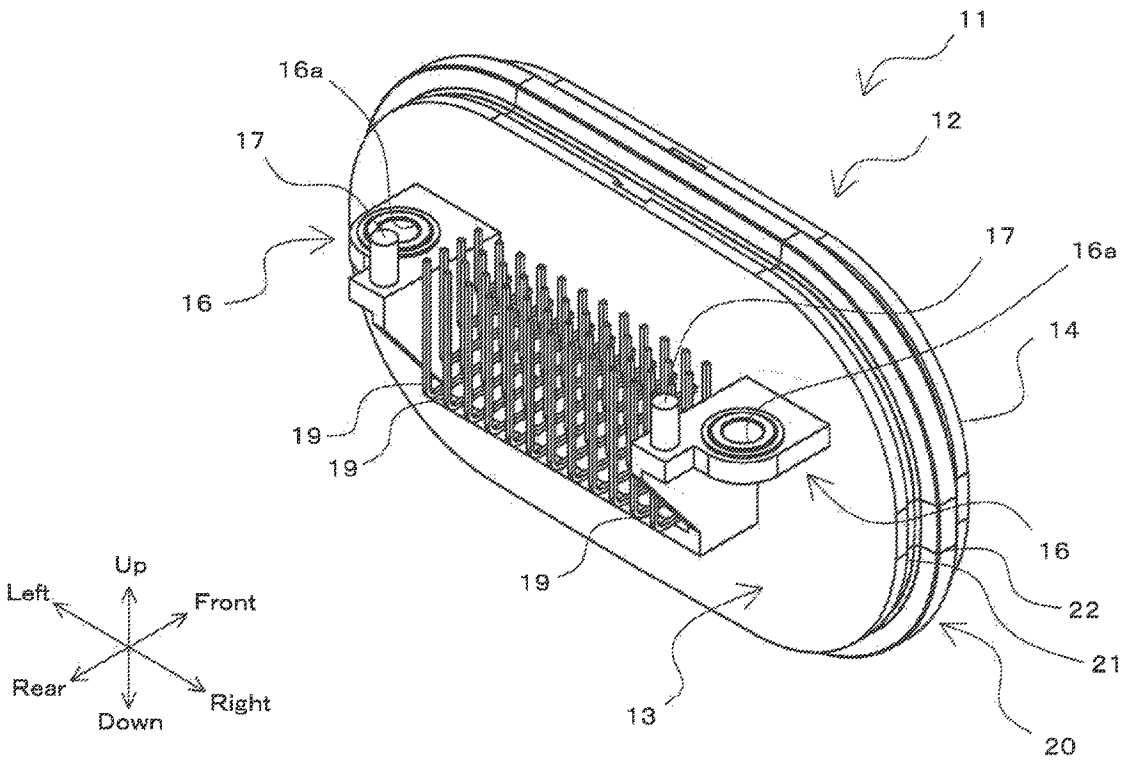
FIG. 5 is a perspective view of the male connector body portion shown in FIGS. 2 and 3, as viewed from the rear side.

FIG. 4 is a perspective view of the male connector body portion 11, as viewed from the front side. Also, FIG. 5 is a perspective view of the male connector body portion 11, as viewed from the rear side. The male connector body portion 11 has a housing 12 (inner housing), multiple male contacts 19, and an inner seal ring 20.

The housing 12 is a member formed by resin molding, and is configured to hold multiple male contacts 19. The housing 12 has a bottom wall portion 13, a peripheral wall portion 14, a tube wall portion 15, and fastening hole portions 16, and these portions are integrated with each other.

The bottom wall portion 13 is a portion that is shaped as a bottom wall and has a predetermined thickness in the front-rear direction, and is approximately shaped as an ellipse that is elongated in the left-right direction. Multiple through-holes (not shown) are formed in the central portion of the bottom wall portion 13 in a view along the front-rear direction, and pass through the bottom wall portion 13 in the front-rear direction. The male contacts 19 are press-fitted into the through-holes. In other words, the bottom wall portion 13 is provided as a contact holding portion that holds the male contacts 19.

The peripheral wall portion 14 is a ring-shaped wall portion formed to extend somewhat forward from the outer circumferential edge portion of the bottom wall portion 13. A ring-shaped groove 14*a* (see FIG. 1) is formed in the outer circumferential surface of the peripheral wall portion 14. An inner seal ring 20 that will be described in detail later is fitted into this ring-shaped groove 14*a*.

The tube wall portion 15 is a tube-shaped wall portion formed to extend forward from a portion of the bottom wall portion 13 that is inward of the peripheral wall portion 14. The tube wall portion 15 extends farther forward than the peripheral wall portion 14 does. The tube wall portion 15 is rectangular and elongated in the left-right direction in a view from the front, and the four corners thereof are R-shaped. Portions of the male contacts 19 on the leading end side (front side) are accommodated inside the tube wall portion 15.

Two fastening hole portions 16 are formed in the rear surface of the bottom wall portion 13 with a gap therebetween in the left-right direction. The fastening hole portions 16 are provided as portions for attachment to the case 2 and the substrate 6, and are fixed to the case 2 (specifically, screw fastening portions 2*a* of the case 2) and the substrate 6 by screws 45. Note that the screw fastening portions 2*a* are portions that are integrated with portions of the case 2 other than the screw fastening portions 2*a*. Also, the rear side of each fastening hole portion 16 is provided with a circular column-shaped projection portion 17 that projects upward from the fastening hole portion 16. When the male connector body portion 11 is to be fixed to the substrate 6, the projection portions 17 are inserted into through-holes (not shown) formed in the substrate 6, thus making it possible to position the male connector body portion 11 relative to the substrate 6.

The male contacts 19 are constituted by L-shaped metallic members. As shown in FIG. 1, portions of the male contacts 19 on the leading end side (front side) are press-fitted into through-holes formed in the bottom wall portion 13 of the housing 12. Accordingly, the leading end portions of the male contacts 19 are arranged inside the tube wall portion 15.

The inner seal ring 20 has a ring body portion 21 that is ring-shaped, and a lip portion 22 that is a portion provided to bulge radially outward from the ring body portion 21, and these portions are integrated with each other. In the inner seal ring 20, as shown in FIG. 1, when the ring body portion 21 has been fitted into the ring-shaped groove 14*a* of the peripheral wall portion 14, the leading end portion (outer circumferential portion) of the lip portion 22 is squashed radially inward by the cover housing 31 of the seal cover assembly 30 (described in detail later) and is in close contact with the cover housing 31. Accordingly, it is possible to ensure waterproof capability between the housing 12 and the cover housing 31.

Configuration of Seal Cover Assembly

Figure 6:
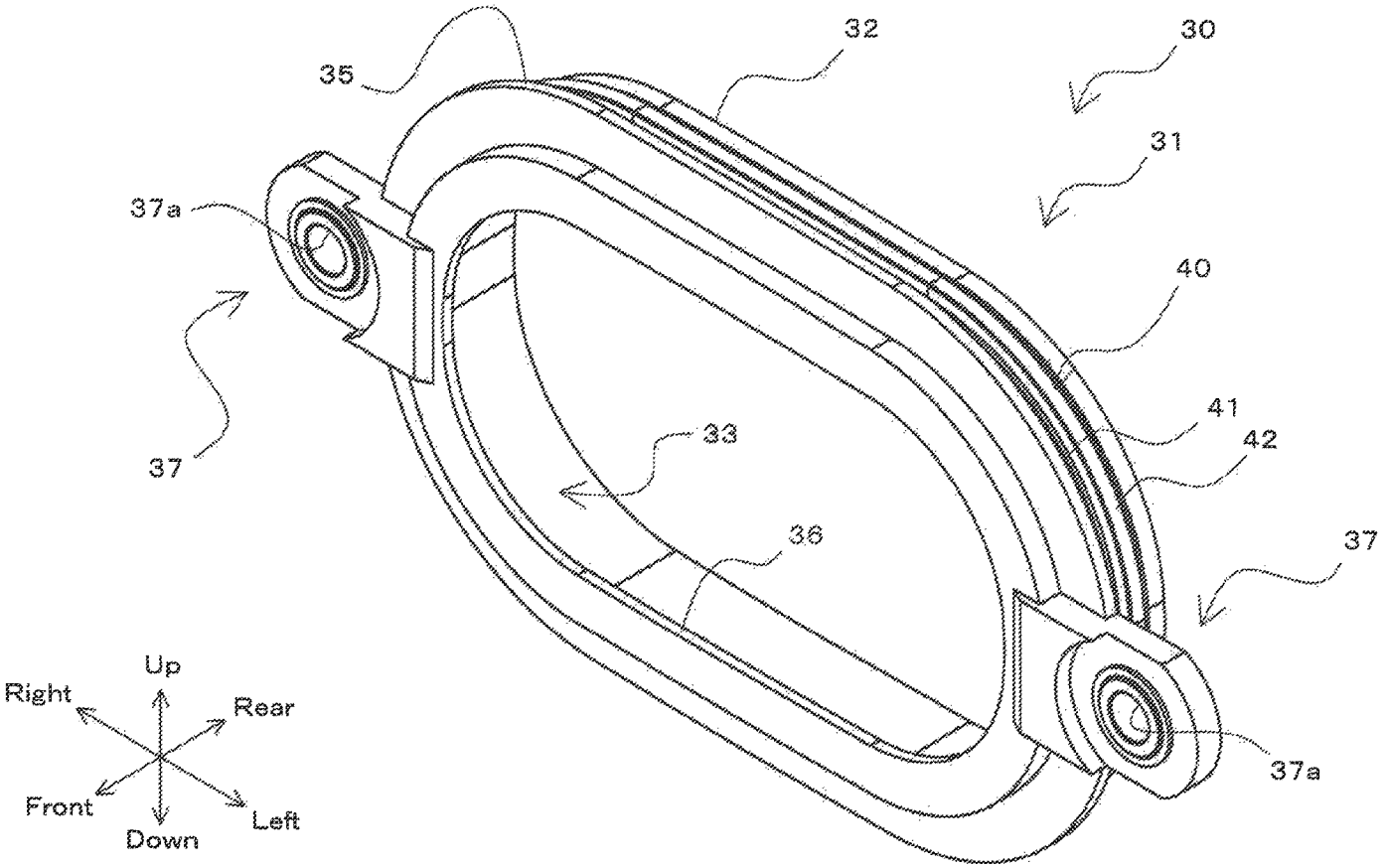
FIG. 6 is a perspective view of a seal cover assembly shown in FIGS. 2 and 3, as viewed from the front side.
Figure 7:
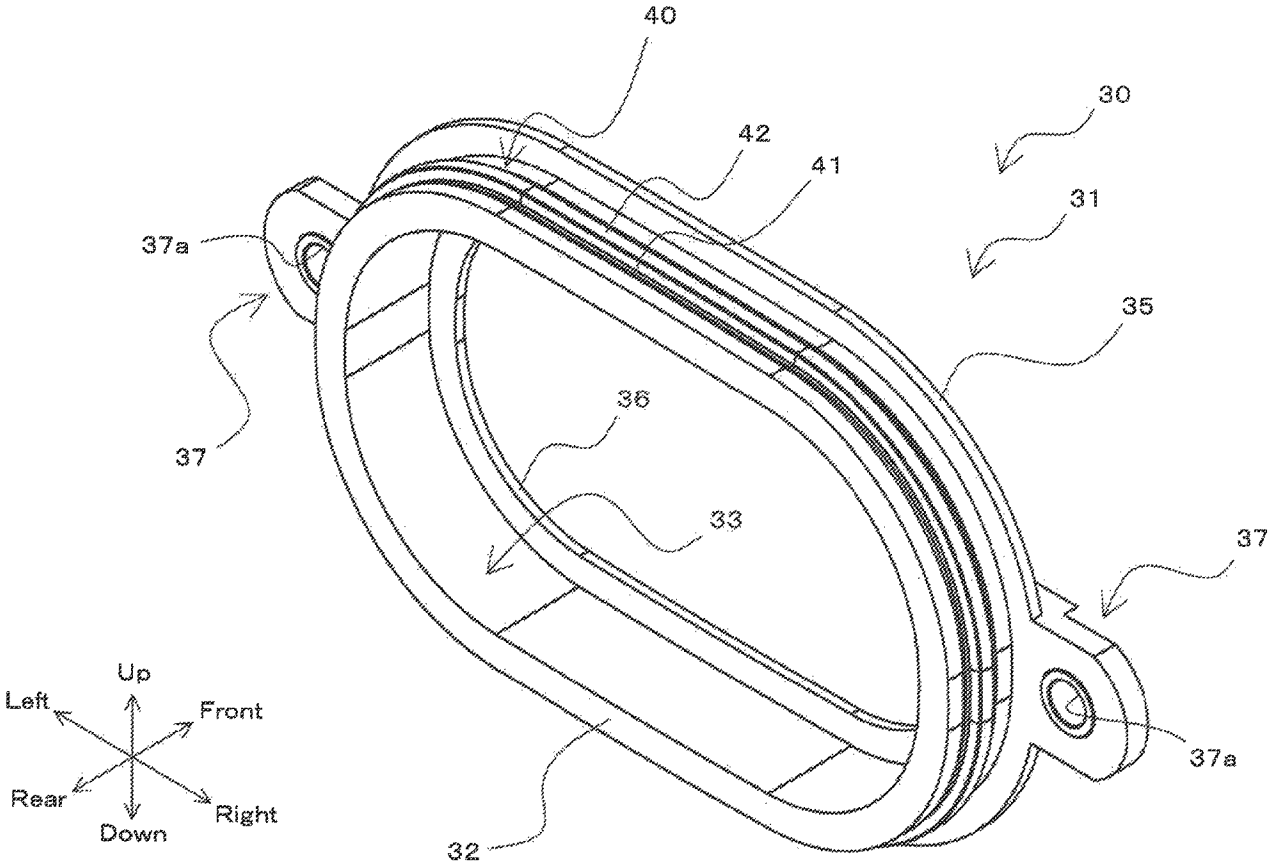
FIG. 7 is a perspective view of the seal cover assembly shown in FIGS. 2 and 3, as viewed from the rear side.

FIG. 6 is a perspective view of the seal cover assembly 30, as viewed from the front side. Also, FIG. 7 is a perspective view of the seal cover assembly 30, as viewed from the rear side. The seal cover assembly 30 has the cover housing 31 (outer housing) and an outer seal ring 40.

The cover housing 31 has a frame portion 32, a flange portion 35, an inward bulging portion 36, and cover housing attachment portions 37 (outer housing attachment portions).

The frame portion 32 is a portion that is approximately frame-shaped and is thick in the front-rear direction. An opening hole portion 33 that is approximately elliptical is formed inside the frame portion 32. As shown in FIG. 1, the central portion of the male connector body portion 11 with respect to the front-rear direction is accommodated inside the opening hole portion 33.

A ring-shaped groove 34 (see FIG. 1) is formed in the portion of the frame portion 32 on the outer circumferential side. The outer seal ring 40 (described in detail later) is fitted into this ring-shaped groove 34.

The flange portion 35 is a flange-shaped portion that is formed so as to bulge somewhat outward from the outer circumferential edge portion on the front side of the frame portion 32. As shown in FIG. 1, the flange portion 35 covers the inner circumferential edge portion of the opening portion 3 of the case 2 from the front side when the male connector 10 has been fixed to the case 2 and the substrate 6.

The inward bulging portion 36 is a portion formed so as to somewhat bulge inward from the inner circumferential edge portion on the front side of the frame portion 32. As shown in FIG. 1, the inward bulging portion 36 is formed somewhat forward of the flange portion 35. The inward bulging portion 36 covers the radially outward portion of the peripheral wall portion 14 of the male connector body portion 11 from the front side when the male connector 10 has been fixed to the case 2 and the substrate 6.

One cover housing attachment portion 37 is formed on each of a right side portion and a left side portion of the frame portion 32. The cover housing attachment portions 37 are provided as portions for attachment to the case 2, and are fixed to the case 2 (specifically, screw fastening portions 2*b* of the case 2) by screws 46. Note that the screw fastening portions 2*b* are portions provided in the opening portion 3 of the case 2.

The outer seal ring 40 has a ring body portion 41 that is ring-shaped, and a lip portion 42 that is a portion provided to bulge radially outward from the ring body portion 41, and these portions are integrated with each other. In the outer seal ring 40, as shown in FIG. 1, when the ring body portion 41 has been fitted into the ring-shaped groove 34 of the frame portion 32, the leading end portion (outer circumferential portion) of the lip portion 42 is squashed radially inward by the case 2 and is in close contact with the case 2.

Accordingly, it is possible to ensure waterproof capability between the cover housing 31 and the case 2.

Steps for Attachment of Male Connector to Case and Substrate

Figure 8:
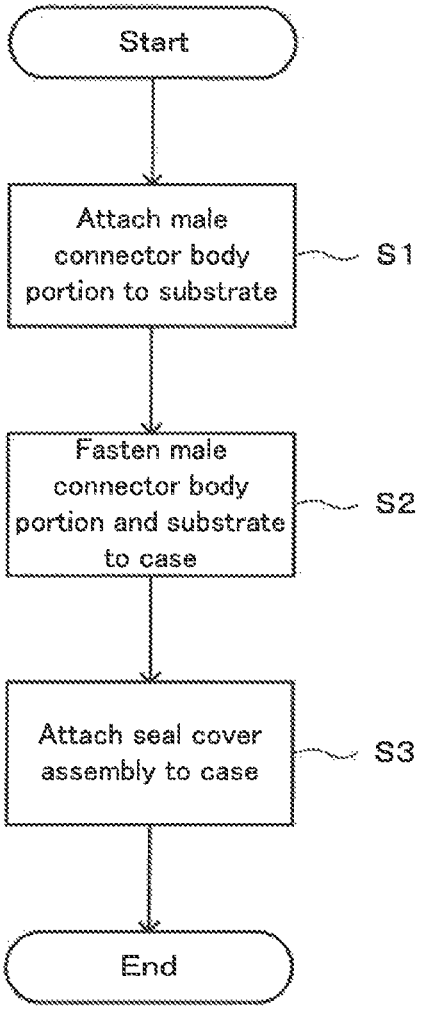
FIG. 8 is a flowchart showing attachment steps when attaching the male connector to a case and a substrate.

FIG. 8 is a flowchart showing attachment steps when attaching the male connector 10 to the case 2 and the substrate 6. The following describes steps for attachment of the male connector 10 to the case 2 and the substrate 6 with reference to FIG. 8.

First, in step S1, the male connector body portion 11 is attached to the substrate 6. Specifically, in step S1, the male contacts 19 and the projection portions 17 formed on the housing 12 are inserted into corresponding hole portions (not shown) of the substrate 6, and then the male contacts 19 are soldered to the substrate 6.

Figure 9:
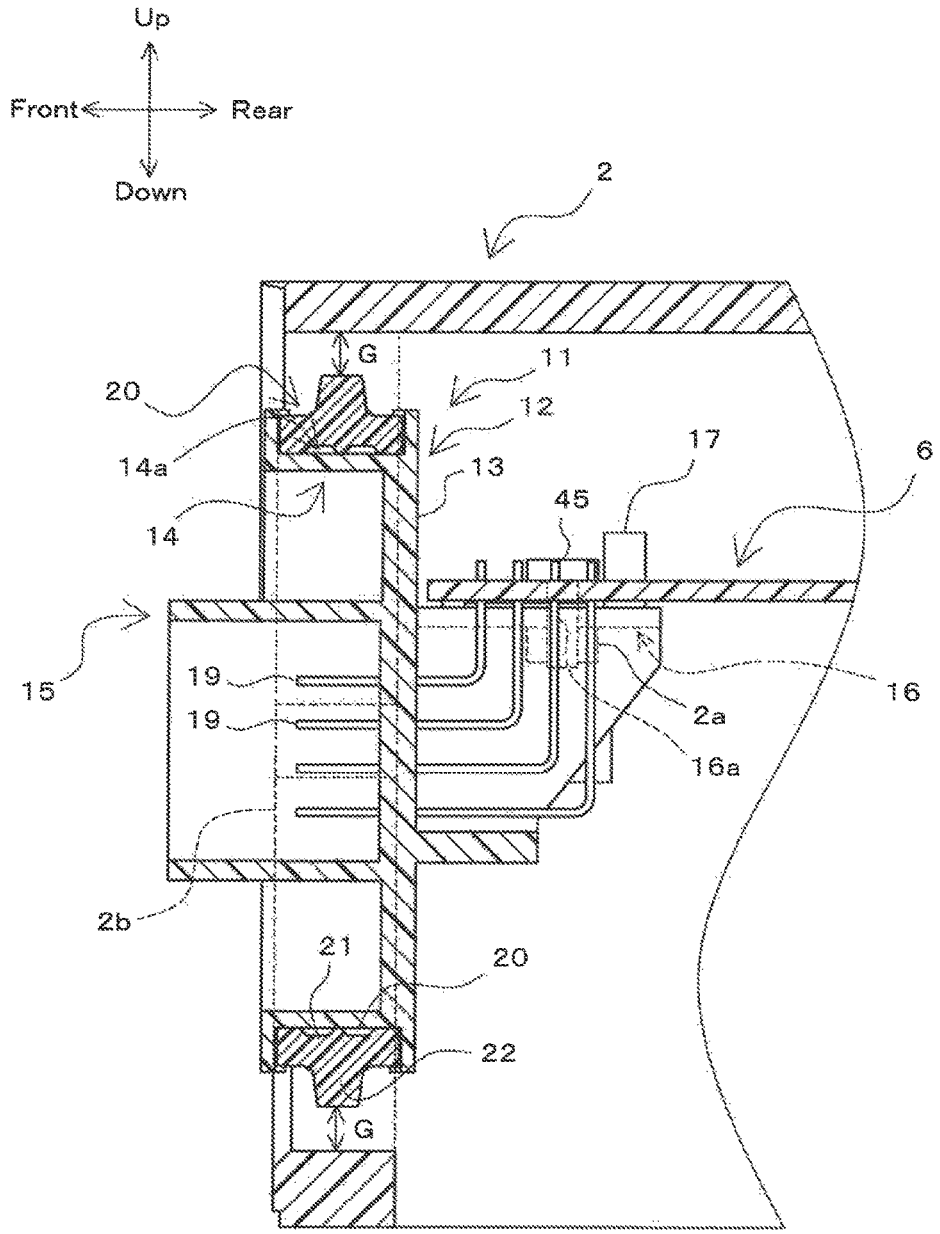
FIG. 9 is a cross-sectional view showing a state in which the substrate and the male connector body portion have been attached to and fixed to the case.

Next, in step S2, the substrate 6 with the male connector body portion 11 mounted thereon is fastened to the case 2. Specifically, in step S2, first the substrate 6 is arranged at a predetermined position in the case 2. In this state, an assembly worker fastens the fastening hole portions 16 to the screw fastening portions 2*a* of the case 2 and the substrate 6 such that the screws 45 serving as fastening members pass through the through-holes 16*a* of the fastening hole portions 16. Accordingly, the substrate 6 and the male connector body portion 11 are attached to and fixed to the case 2. FIG. 9 is a cross-sectional view showing the case 2 and the male connector body portion 11 in the state where step S2 is complete. In this state, the gap G is formed between the case 2 and the male connector body portion 11 as shown in FIG. 9.

Lastly, in step S3, the seal cover assembly 30 is attached to the case 2. Specifically, the frame portion 32 of the seal cover assembly 30 and the outer seal ring 40 fitted into the ring-shaped groove 34 of the frame portion 32 are fitted so as to be pressed into the gap G between the case 2 and the male connector body portion 11. Then, in this state, the cover housing attachment portions 37 are screwed to the screw fastening portions 2*b* provided in the opening portion 3 of the case 2 using the screws 46 such that the screws 46 pass through through-holes 37*a* of the cover housing attachment portions 37. Accordingly, the seal cover assembly 30 is fastened to the opening portion 3 of the case 2 in the state of being fitted into the gap G between the case 2 and the male connector body portion 11. In this way, by performing the steps from step S1 to step S3, it is possible to attach the male connector 10 to the case 2 and the substrate 6.

Effects

As described above, with the male connector 10 of the present embodiment, the housing 12 that holds the male contacts 19 is attached to the substrate 6, and then the substrate 6 is placed in the case 2 and fixed thereto by the screws 45. The cover housing 31 is provided between the housing 12 and the case 2 in this state. Accordingly, it is possible to attach the male connector 10 to the case 2 and the substrate 6 in a state in which rattling of the housing 12 relative to the case 2 is suppressed.

Also, according to the male connector 10, even if the shape of the opening portion 3 that is the attachment target of the male connector 10 is changed according to a change in the design of the case 2 for example, it is possible to change only the shape of the outer portion (cover housing 31) of the male connector 10 and use the male connector body portion 11 that has the male contacts 19 as is. Accordingly, many individual parts used in the male connector body portion 11 can be used as is in other applications, and there is no need to again perform performance evaluation testing for such new male connector body portions 11. Therefore, according to the male connector 10, it is possible to reduce the cost of making alterations to the connector required by a design modification made to the case 2, and it is possible to reduce the number of man hours for additional performance evaluation testing that is to be performed.

Therefore, according to the male connector 10, it is possible to provide a connector whose shape can be easily changed according to a change in the shape of the opening portion of the case to which the connector is to be attached.

Note that conventionally known connectors have had problems such as the following when a substrate with such a connector mounted thereon is fixed to a case. Specifically, when the substrate with the connector mounted thereon is placed in and fixed to the case, the substrate and the connector are arranged at an appropriate position while pressing the seal ring or the like provided around the housing of the connector closely against the opening portion of the case, and then the substrate is fixed to the case by screw fastening or the like. However, when the substrate is placed at the predetermined position in the case while pressing the connector against the opening portion of the case, there are cases where, depending on how the seal ring undergoes elastic deformation, the substrate is fixed to the case in an overall distorted state. This distortion occurs in the mounted parts on the substrate as well.

In regards to this, according to the male connector 10, first the substrate 6 with the housing 12 attached thereto is placed in the case 2, and then the fastening hole portions 16 can be fastened by the screws 45 to both the case 2 and the substrate 6. At this time, the gap G is formed between the housing 12 and the case 2, and therefore the substrate 6 does not become distorted.

Thereafter, the cover housing 31 is pressed and fitted into the gap G, and fixed to the case 2. At this time, stress is concentrated in the regions of the substrate 6 in the vicinity of the locations where the housing 12 is fastened to both the substrate 6 and the case 2 (referred to hereinafter as fastening location vicinal regions), and therefore distortion occurs in these fastening location vicinal regions. These fastening location vicinal regions are regions of the substrate 6 in the vicinity of the fastening hole portions 16 of the housing 12. Accordingly, these regions are relatively small regions, and very few mounted parts are mounted in these fastening location vicinal regions, or no mounted parts are mounted in these fastening location vicinal regions. In other words, all or almost all of the mounted parts on the substrate 6 are mounted in regions of the substrate 6 where distortion does not occur (regions other than the fastening location vicinal regions). Therefore, according to this configuration, when the substrate 6 with the connector 10 attached thereto is fixed to the case 2, it is possible to suppress distortion of the mounted parts on the substrate 6, thus making it possible to greatly reduce the risk of damage or the like to the mounted parts.

Also, according to the male connector 10, waterproof capability between the housing 12 and the cover housing 31 can be appropriately ensured by the inner seal ring 20.

Also, according to the male connector 10, waterproof capability between the cover housing 31 and the case 2 can be appropriately ensured by the outer seal ring 40.

Furthermore, according to the male connector 10, it is possible to obtain a two-tier structure in the diameter direction with the two seal rings 20 and 40 (specifically, the inner seal ring 20 and the outer seal ring 40 are arranged concentrically). Accordingly, the height of the lip portions 22 and 42 of the seal rings 20 and 40 can be set to approximately half the conventional height, for example. Accordingly, it is possible to suppress pinching of the seal rings 20 and 40 during mating, which can occur due to the lip height (specifically, during product assembly, the lip portions 22 and 42 become sandwiched between the housing 12 and the cover housing 31 or between the cover housing 31 and the case 2, for example).

Also, according to the male connector 10, the cover housing 31 can be appropriately and firmly fixed to the case 2 using the screws 46.

Also, according to the in-vehicle device 1, it is possible to provide a connector unit that includes the male connector 10 whose shape can be easily changed according to a change in the shape of the opening portion 3 of the case 2 to which the male connector 10 is to be attached.

Also, according to the in-vehicle device 1, it is possible to prevent distortion of the mounted parts on the substrate 6 when the substrate 6 with the male connector 10 mounted thereon is fixed to the case 2.

Although embodiments of the present invention have been described above, the present invention is not limited to these embodiments, and various modifications can be made without departing from the gist of the invention. In other words, the present invention is not limited to the above embodiments, and all modifications, applications, and equivalents thereof that fall within the claims, for which modifications and applications would become naturally apparent by reading and understanding the present specification, are intended to be embraced in the claims of the invention.

Figure 10:
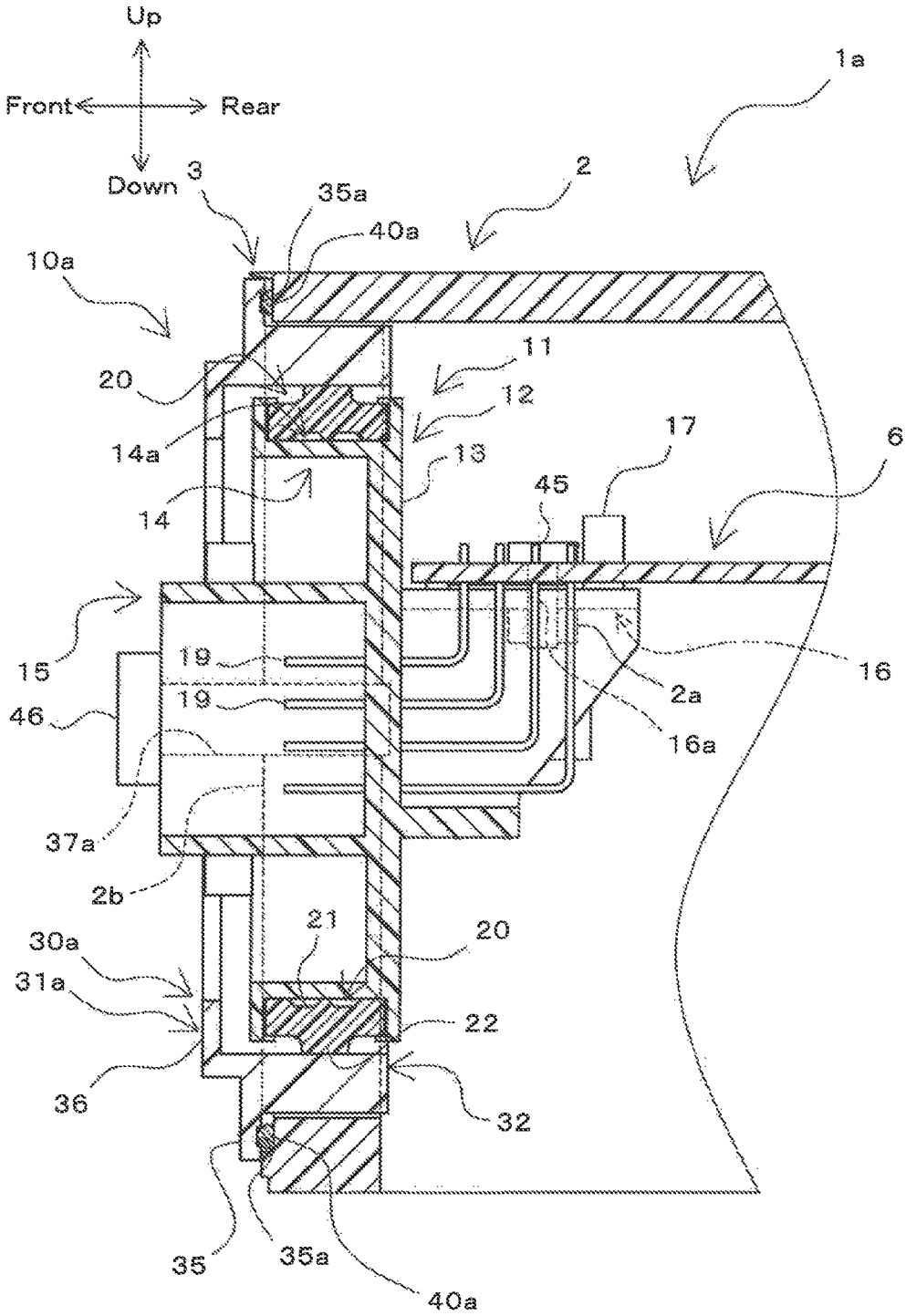
FIG. 10 is a cross-sectional view showing the vicinity of a male connector in an in-vehicle device according to a variation.

Variations (1) FIG. 10 is a cross-sectional view of a portion of an in-vehicle device 1*a* according to a variation. In the in-vehicle device 1*a* according to the present variation, the seal structure for the seal cover assembly and the case is different from that in the in-vehicle device 1 according to the above embodiment. Specifically, in the present variation, the shape of an outer seal ring 40*a* of a seal cover assembly 30*a* is different from the case of the above embodiment. Also, in the present variation, the position at which the outer seal ring 40*a* is arranged on a cover housing 31*a* is different from the case of the above embodiment. The following describes portions that are different from the above embodiment, and descriptions will not be given for other portions.

As shown in FIG. 10, the cover housing 31*a* of a male connector 10*a* of the present variation has a structure that omits the ring-shaped groove 34 formed in the frame portion 32 of the cover housing 31 of the embodiment described above. Instead, a ring-shaped groove 35*a* is formed in the rear surface of the flange portion 35 of the cover housing 31*a*. A ring-shaped outer seal ring 40*a* is fitted into the ring-shaped groove 35*a*. This seal ring 40*a* is formed to have a circular cross-sectional shape. In the in-vehicle device 1*a* of the present variation, this seal ring 40*a* is provided between the flange portion 35 and the opening portion 3 of the case 2. Note that FIG. 10 shows the seal ring 40*a* in a deformed state when sandwiched between the case 2 and the cover housing 31*a*.

As described above, even in the case where the seal structure between the cover housing 31*a* and the case 2 is configured according to the present variation, it is possible to ensure waterproof capability between the cover housing and the case similarly to the case of the above embodiment.

Even with the male connector 10*a* according to the present variation that has a different seal structure from that of the above embodiment, effects similar to those of the case of the above embodiment can be obtained.

Figure 11:
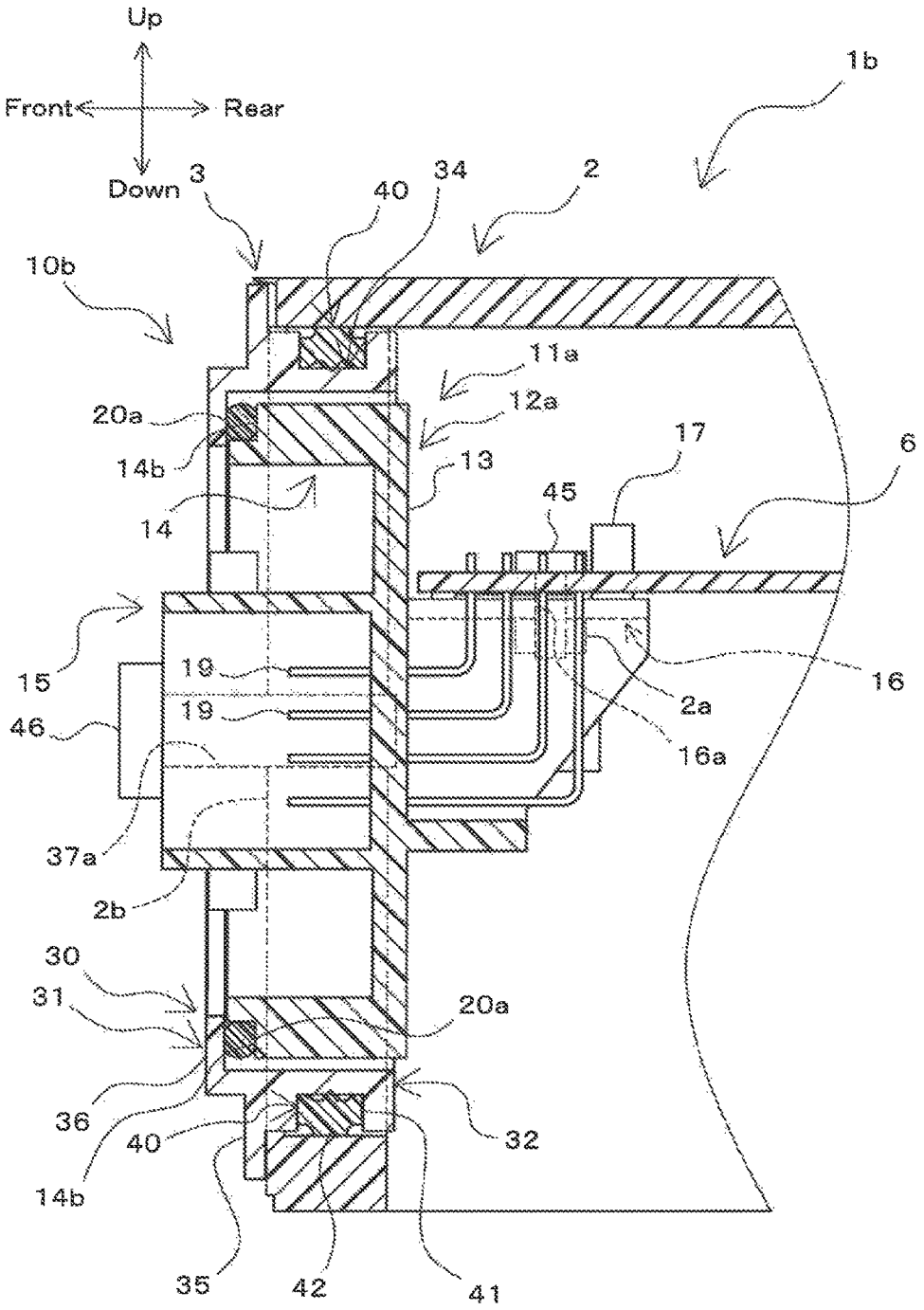
FIG. 11 is a cross-sectional view showing the vicinity of a male connector in an in-vehicle device according to another variation.

(2) FIG. 11 is a cross-sectional view of a portion of an in-vehicle device 1*b* according to a variation. In the in-vehicle device 1*b* according to the present variation, the seal structure for the male connector body portion and the seal cover assembly is different from that in the in-vehicle device 1 according to the above embodiment. Specifically, in the present variation, the shape of an inner seal ring 20*a* of a male connector body portion 11*a* is different from the case of the above embodiment. Also, in the present variation, the position at which the inner seal ring 20*a* is arranged on a housing 12*a* is different from the case of the above embodiment. The following describes portions that are different from the above embodiment, and descriptions will not be given for other portions.

As shown in FIG. 11, the housing 12*a* of a male connector 10*b* of the present variation has a configuration that omits the ring-shaped groove 14*a* formed in the peripheral wall portion 14 of the housing 12 in the embodiment described above. Instead, a ring-shaped groove 14*b* is formed in the outer edge portion on the front side of the peripheral wall portion 14 of the housing 12*a*. A ring-shaped inner seal ring 20*a* is fitted into the ring-shaped groove 14*b*. This seal ring 20*a* is formed to have a circular cross-sectional shape. Note that FIG. 11 shows the seal ring 20*a* in a deformed state when sandwiched between the cover housing 31 and the housing 12*a*.

As described above, even in the case where the seal structure between the housing 12*a* and the cover housing 31 is configured according to the present variation, it is possible to ensure waterproof capability between the housing and the cover housing similarly to the case of the above embodiment.

Even with the male connector 10*b* according to the present variation that has a different seal structure from that of the above embodiment, effects similar to those of the case of the above embodiment can be obtained.

Figure 12:
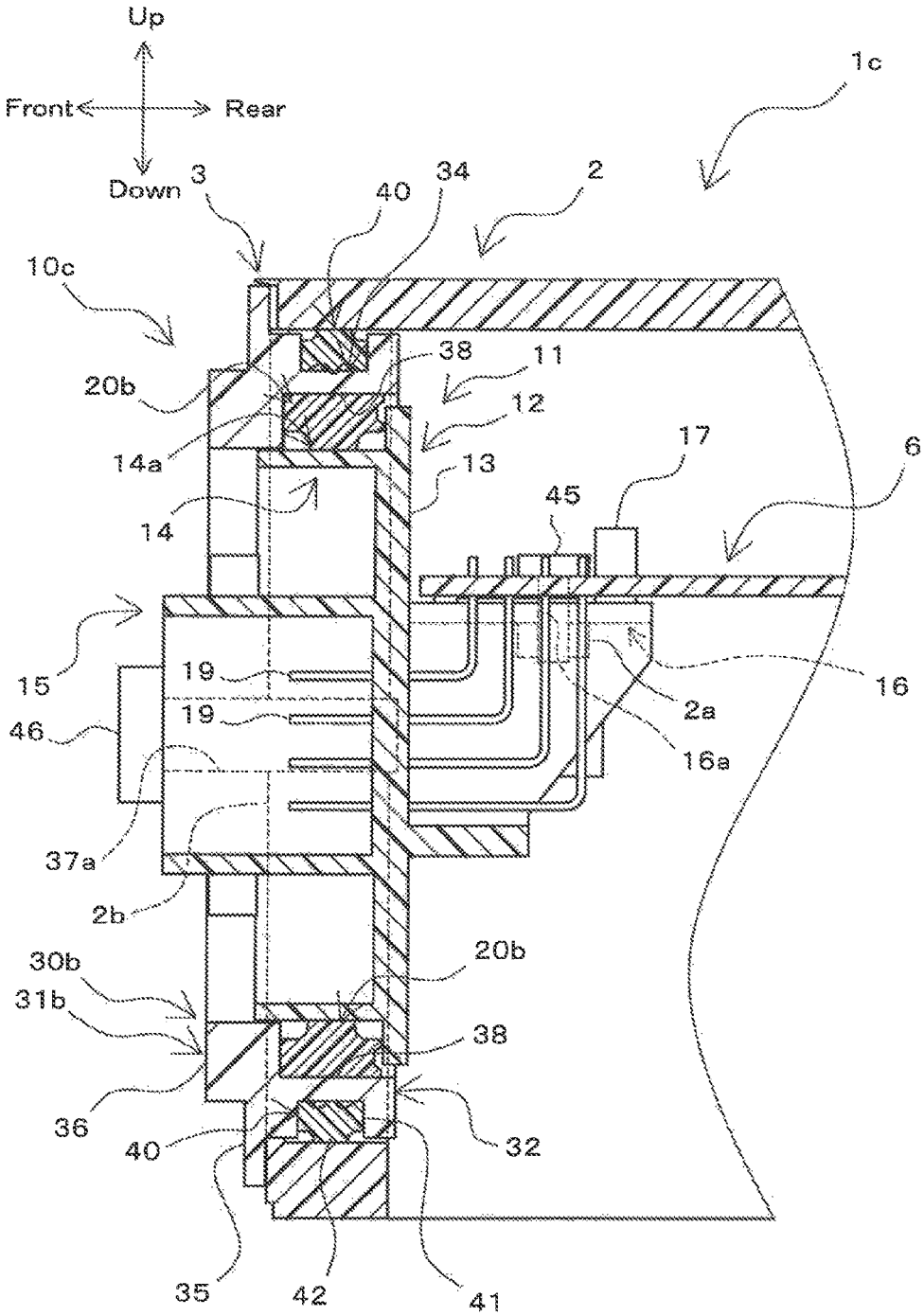
FIG. 12 is a cross-sectional view showing the vicinity of a male connector in an in-vehicle device according to yet another variation.

(3) FIG. 12 is a cross-sectional view of a portion of an in-vehicle device 1*c* according to a variation. The in-vehicle device 1*c* of the present variation has a configuration that omits the inner seal ring 20 provided on the male connector body portion 11 of the in-vehicle device 1 according to the above embodiment, and instead, an inner seal ring 20*b* is provided on a step portion 38 formed in the inner circumferential surface of the frame portion 32 of a cover housing 31*b* of a seal cover assembly 30*b*. Even with this configuration, it is possible to ensure waterproof capability between the cover housing and the case similarly to the case of the above embodiment.

Even with a male connector 10*c* according to the present variation that has a different seal structure from that of the above embodiment, effects similar to those of the case of the above embodiment can be obtained.

(4) In the embodiment described above, waterproof capability between the cover housing 31 and the case 2 is ensured by providing the outer seal ring 40 between the cover housing 31 and the case 2, but the present invention is not limited to this. Specifically, in one example, by sealing the cover housing 31 and the case 2 with an adhesive, it is possible to fix these two members to each other and also ensure waterproof capability between them, and it is also possible to easily replace the male connector body portion in the seal cover assembly.

(5) Although the in-vehicle device 1 is described as an example of the connector unit in the above embodiment, the present invention is not limited to this, and the connector unit may be another unit.

The present invention is broadly applicable to a connector and a connector unit that includes the connector.

What is claimed is:

1. A connector comprising:

an inner housing that has a contact holding portion holding at least one contact, the inner housing being configured to be attached to a substrate; and an outer housing that is configured as a separate body from the inner housing, the outer housing being configured to be provided between a case with the substrate attached thereto and the inner housing and to be fixed to the case, and the outer housing suppressing rattling of the inner housing relative to the case, wherein the outer housing forms a through hole for at least partially accommodating the inner housing, wherein the inner housing has a fastening hole portion that is configured to be fastened to both the case and the substrate by a fastening member, a gap is formed between the inner housing and the case in a state where the substrate with the inner housing attached thereto is fastened to the case by the fastening member, and the outer housing is provided in the gap.

2. The connector according to claim 1, further comprising a ring-shaped inner seal ring that is provided between the inner housing and the outer housing.

3. The connector according to claim 2, further comprising a ring-shaped outer seal ring that is provided between the outer housing and the case.

4. The connector according to claim 1, wherein the outer housing has an outer housing attachment portion that is configured to be attached to the case by a screw.

5. A connector unit comprising:

a case;

a substrate configured to be attached to the case; and a connector according to claim 1 that is configured to be attached to the substrate.

6. The connector unit according to claim 5, wherein an inner housing of the connector has a fastening hole portion that is configured to be fastened to both the case and the substrate by a fastening member, a gap is formed between the inner housing and the case in a state where the substrate with the inner housing attached thereto is fastened to the case, and an outer housing of the connector is provided in the gap.

* * * * *